United States Patent [19]

Sterba et al.

[11] Patent Number: 4,871,166

[45] Date of Patent: Oct. 3, 1989

[54] MULTI-PURPOSE EXERCISE BENCH SYSTEM

[76] Inventors: Richard F. Sterba, 9536 Bauer Ave., Baltimore, Md. 21236; James R. Slade, Jr., 45 Cedar Hill Rd., Randallstown, Md. 21133

[21] Appl. No.: 678,087

[22] Filed: Dec. 4, 1984

[51] Int. Cl.[4] ..... A63B 21/00

[52] U.S. Cl. ..... 272/144

[58] Field of Search ..... 272/93, 117, 118, 123, 272/134, 136, 144, 145, 900, DIG. 4; 108/91, 93, 96

[56] References Cited

U.S. PATENT DOCUMENTS

| | | | |
|---|---|---|---|
| 2,427,761 | 9/1947 | Bull | 272/900 X |
| 2,831,687 | 4/1958 | Hunter | 272/145 |
| 3,342,485 | 9/1967 | Gaul | 272/123 |
| 3,406,933 | 10/1968 | Wait et al. | 108/93 X |
| 3,850,430 | 11/1974 | Hamilton | 272/117 |
| 3,874,657 | 4/1975 | Niebojewski | 272/DIG. 4 X |
| 4,247,098 | 1/1981 | Brentham | 272/134 X |
| 4,319,747 | 3/1982 | Rogers | 272/144 |
| 4,358,108 | 11/1982 | Voris | 272/134 X |
| 4,358,109 | 11/1982 | Schrems | 272/134 X |
| 4,363,481 | 12/1982 | Erickson | 272/134 X |
| 4,382,596 | 5/1983 | Silberman | 272/145 |
| 4,390,179 | 6/1983 | Szkalak | 272/134 X |
| 4,396,191 | 8/1983 | Metler | 272/123 |
| 4,492,375 | 1/1985 | Connelly | 272/136 X |
| 4,505,475 | 3/1985 | Olshansky | 272/134 X |
| 4,546,967 | 10/1985 | Kecala | 272/144 X |

FOREIGN PATENT DOCUMENTS

| | | | |
|---|---|---|---|
| 3212544 | 10/1983 | Fed. Rep. of Germany | 272/144 |
| 2065482 | 7/1981 | United Kingdom | 272/144 |

*Primary Examiner*—Richard J. Apley
*Assistant Examiner*—Robert W. Bahr

[57] ABSTRACT

A exercise bench system has a lower bench that rests on the floor and carries on it a separate upper bench in any of three positions of interfit: (1) collapsed flat on the lower bench, (2) inclined relative to the lower bench, (3) upstanding parallel with the lower bench. The upper bench has detachably affixed to it, by stud and socket and flange hook, a leg extension-leg curl pivotal component that can be set for limited pivot if desired. Seat structures provide an incline position on the lower bench when horizontal, in cooperation with the pivotal component fixed to act as a post. The lower bench has transverse base members connecting the lower portions of the legs, and a pulley for guiding when a line is attached to the pivotal component and run back to any suitable weight stack.

32 Claims, 4 Drawing Sheets

MULTI-PURPOSE EXERCISE BENCH SYSTEM

FIELD OF THE INVENTION

This invention relates generally to exercise equipment and specifically to a bench-type system for body support.

BACKGROUND OF THE INVENTION

Many benches that provide body support while exercising are known.

Examples include those disclosed in the following U.S. Pat. Nos.:

3,342,485 to M. Gaul, 9-19-67, disclosed an exercise bench with subframe and superstructure, both with leg-like portions, but adjustable to provide various inclined positions;

4,319,747 to J. F. Rogers, 3-16-82, disclosed an exercise bench with end-sockets holding a pivotal member, provided with weights, for engagement by feet (see particularly FIG. 7) and with inclinable surface;

4,382,596 to I. J. Silberman, 5-10-83, disclosed another form of exercise bench with end-supported, pivotal, weight-carrying mechanism for leg exercising.

However, none of the above or any bench apparatus known to the present is believed to provide the advantages of this invention.

SUMMARY OF THE INVENTION

A principal object of the invention is to provide a sectionalized, interlocking weight lifting exercise bench system that can be quickly adjusted to place the bench pad surface which the user lies or sits on in various spatial positions, in terms of bench pad height and angle of incline and decline, for performing various weight lifting exercises such as the bench press, declined bench press, inclined bench press, inclined sit-ups, and leg extensions and leg curls.

Further objects are to provide a multi-exercise weight lifting bench system that maximizes the amount of bench pad surface that contacts the user's body so that body weight is comfortably supported during each exercise by as much bench pad surface as possible, thereby reducing the chances for compression injuries to muscles and tendons.

A further object is to provide a multi-exercise weight lifting bench system that can be incorporated in various exercise systems of either the free weight design or slider mechanism design.

A further object is to provide a unique leg extension-leg curl assembly that is also used as a support post for the inclined bench press exercise and as a foot-hold mechanism for the inclined sit-ups and declined bench press exercises.

Still a further object is to provide a unique hooked clamping flange for the leg extension-leg curl assembly which acts as a safety catch when the leg extension-leg curl assembly is used as a support post for the inclined bench press exercise.

And still further objects are to provide a bench system that provides not only exercise versatility but also durability, overall ease of use, reliability, and compactness.

These advantages are provided by a system having two separate but vertically interlockable benches. In addition, as separate parts, there are one pivotal attachment with pivot pin for co-acting with a weight pulley when desired, and four cushioned bench pad or seat elements, plus one steel pin and one prop. There are no delicate parts and no intricate fabrications or adjustments.

The two benches fit together in three relations. The lower bench always stands flat on the floor with:

1. the upper bench and the lower bench nested so that the nested height is little more than that of either bench standing alone; this is the FIRST POSITION;

2. the upper bench supported in a longitudinally inclined position on the lower bench; this is the SECOND POSITION;

3. the upper bench standing upright on and parallel with the lower bench; this is the THIRD POSITION.

As will be seen, at the FIRST POSITION, seat variations provide further adjustment. With this in mind, the following will be better appreciated.

(A) The bench within a bench concept permits the entire bench pad surface to be spatially positioned at varying heights and angles so that the different exercises can be performed.

(B) The leg extension-leg curl assembly serves triple purposes:

1. for leg extension and leg curl exercises;

2. as a support post for a detachable incline front seat that is inserted on the upper bench section so that inclined bench presses can be performed (note: an additional steel pin is inserted to immobilize the pivot for this mode of operation); and, 3. as a foot-hold mechanism for doing inclined sit-ups and declined bench presses (note: the additional steel pin is also inserted for this mode of operation).

(C) A pivot bracket member which is part of the leg extension-leg curl assembly provides a special hooked clamping flange for additional safety.

Explanation of some of the main aspects of the exercise bench that were touched on above:

(A) Bench within a bench concept

The upper bench (with attached bench pads) can be positioned, as noted, in a low horizontal, high horizontal, or inclined intermediate position on the separate lower bench. Because the upper bench can be set at three spatial positions relative to the lower bench, the user's body can be placed at the proper height and/or angle for doing a particular exercise. For example, when the upper bench is in the low horizontal position, FIRST POSITION, the user can bench press with his feet placed firmly on the floor surface, thereby providing complete stability during the exercise. When the upper bench is in the high horizontal position, THIRD POSITION, the user has sufficient foot clearance from the floor for doing the leg extension exercise.

(B) The leg extension-leg curl assembly performs three different functions depending on the type of exercise being performed Function one: When the leg extension-leg curl assembly is used for leg extension or leg curl exercises, the pivoting, "L"-shaped member is in a down position and is attachable by a pulley/cable mechanism to any convenient weight stack so that the leg extension/leg curl exercise can be performed.

Function two: When the leg extension-leg curl assembly is used as the support post for the detachable incline front seat, that is used for inclined bench pressing, the pivoting, "L"-shaped member is rotated to an up position and a detachable steel locking pin is inserted through aligned holes in the pivot bracket member and the "L"-shaped member of the leg extension-leg curl assembly. When the steel locking pin is inserted through the aforementioned pin holes, the "L"-shaped member is locked in the up position, which permits it to be used as a support post.

Function three: When the leg extension-leg curl assembly is used as a foot-hold mechanism for doing inclined sit-ups and declined bench presses, the pivoting, "L"-shaped member is in the down position and the steel locking pin is inserted only through the locking pin hole that is in the "L"-shaped member. In this position, the steel locking pin extends across (and slightly above) the top edges of the two parallel steel plates that form the channel opening of the pivot bracket member into which is inserted the pivoting, "L"-shaped member. When the user pushes on the lower foot pads of the "L"-shaped member, the "L"-shaped member is allowed to rotate perhaps 5 to 15 degrees before the "L"-shaped member is blocked from further rotation by the steel locking pin which hits down on the parallel steel plates of the pivot bracket member. With the "L"-shaped member blocked from further rotation, the lower foot pads (leg extension pads) function as footholds across the in-step of both feet.

(C) The pivot bracket member of the leg extension-leg curl assembly has, as noted, a special hooked clamping flange that counters the tremendous rotational forces that are imposed on the leg extension-leg curl assembly when the "L"-shaped member is locked in the up position for use as a support post, during inclined bench pressing. As will be seen, the pivot bracket member has two cylindrical studs that insert into tubular holders welded to the front legs of the upper bench. These cylindrical studs keep the pivot bracket member properly positioned in the center of the front end of the upper bench section. The hooked clamping flange which is also an integral part of the pivot bracket member hooks over and behind the front end piece of the upper bench. When the pivot bracket member is inserted in place, the hooked clamping flange functions, as noted, as a safety mechanism to relieve torque loading of the leg extension-leg curl assembly when the user and weights employed apply force down onto the detachable incline front seat which is being propped up at the front end of the exercise bench by the "L"-shaped member of the leg extension-leg curl assembly.

Said another way, this exercise bench system has a lower bench that rests on the floor and carries on it a separate upper bench in any of three positions of interfit: (1) collapsed flat on the lower bench, (2) inclined relative to the lower bench, (3) upstanding parallel with the lower bench. The upper bench has detachably affixed to it, by stud and socket and clamping flange or hook, a leg extension-leg curl pivotal component that can be set for limited pivot if desired. Seat structures provide an incline position on the exercise bench when the upper bench is horizontally nested, in cooperation with the pivotal component fixed to act as a post. The lower bench has transverse members connecting the lower portions of the legs, for stability, and a pulley for guiding when a line is attached to the pivotal component and run back to any suitable weight stack.

BRIEF DESCRIPTION OF THE DRAWINGS

The above and other objects and advantages of this invention will become more readily apparent on examination of the following description, including the drawings in which like reference numerals refer to like parts.

DETAILED DESCRIPTION

Overview

Figure 1:
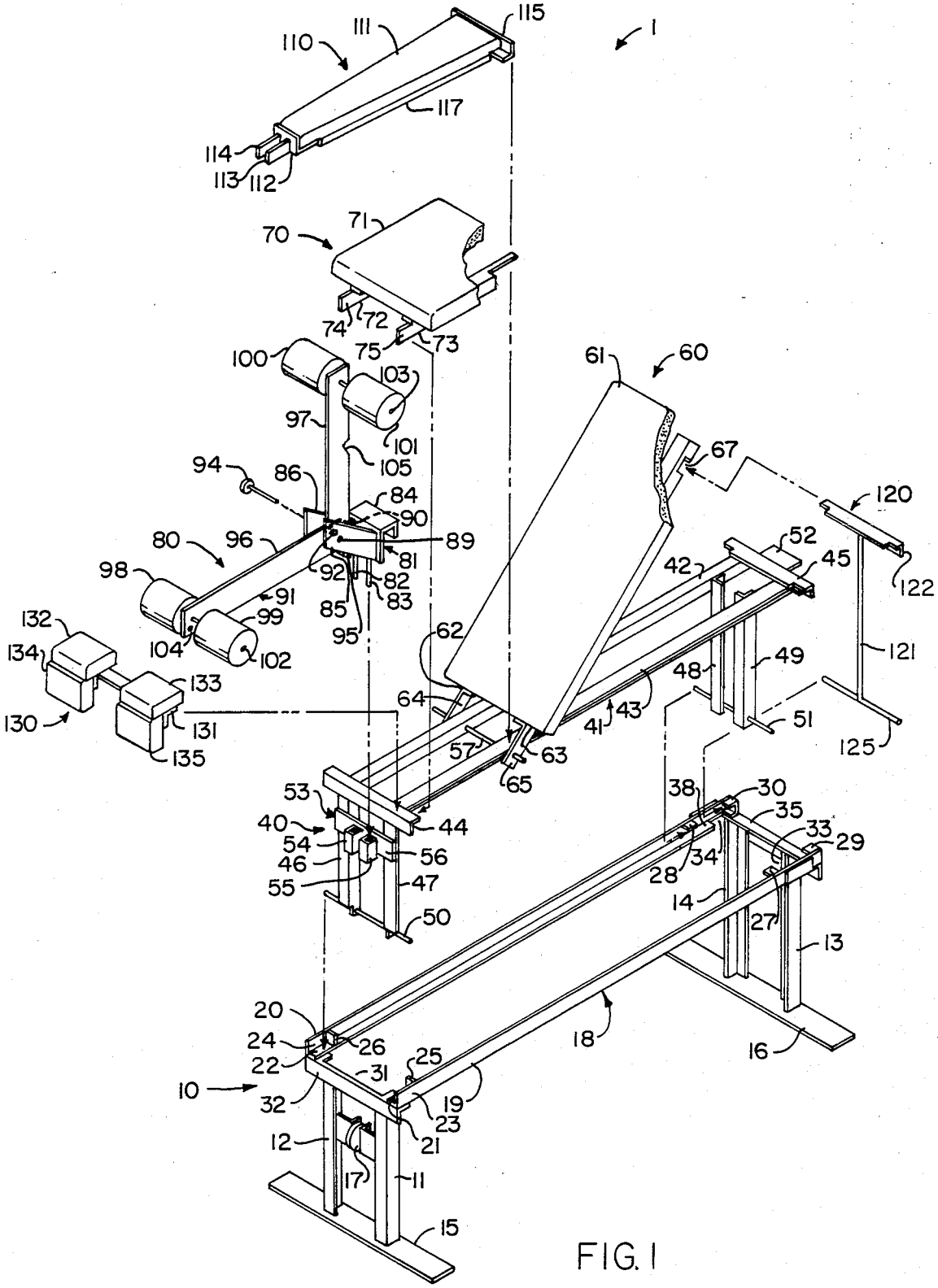
FIG. 1 is an exploded perspective view of a preferred embodiment of the invention.

FIG. 1 shows the invention in embodiment 1 as comprising three major groupings of components: lower bench 10 that always rests on the floor and supports the other components, a separate upper bench 40, with attached rear seat 60 and separable front seat 70, that interfits with the lower bench in three modes, and leg extension-leg curl assembly 80, with leg extension/leg curl seat 130, for attachment to the upper bench to provide for leg extension and leg curl exercising.

As will be seen, further components, including an inclined bench pressing front seat 110, and an "I"-shaped prop 120 are used in special application.

FIRST POSITION

The Benches

Figure 2A:
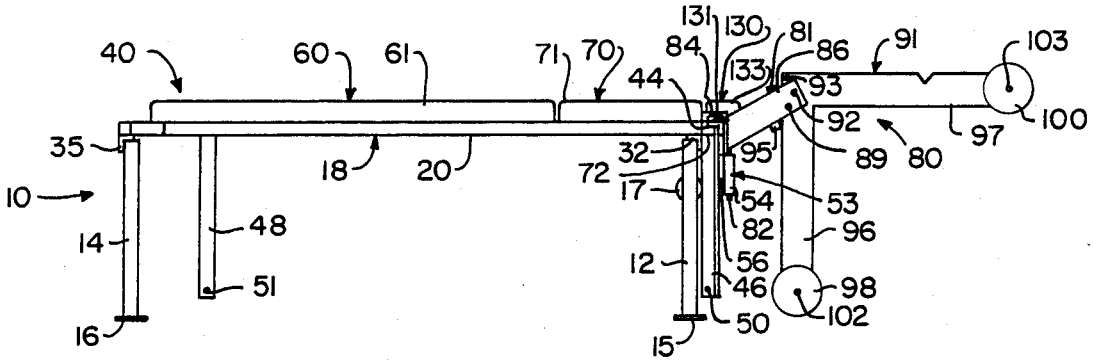
FIG. 2*a* is a side elevational view of a first relative interfit position of the upper and lower benches of this invention.

FIGS. 1 and 2*a* will be described together to indicate the FIRST POSITION or mode of interfit of the upper and lower benches, a nesting interlocking, with the upper bench 40 resting on the lower bench 10 in parallel relation.

The lower bench has preferably two front and two rear legs 11, 12, 13, 14, in equal length pairs. Transverse base members 15, 16 extend to the sides and stabilize the lower bench. A pulley 17 is provided between the front legs, for purposes to be described.

A rectangular frame 18 of angle iron is supported by one of the legs at each corner. The frame channel side angles 19, 20 are oriented with first legs 21, 22 extending inward from second legs 23, 24 which extend upward as one means for supporting and containing the upper bench, in conjunction with paired front stops 25, 26, and paired rear holddown flanges 27, 28 projecting inward from angle second legs 23, 24 in spaced relation with angle first legs 21, 22; and paired rearmost "U"-clips 29, 30 on the channel side angles. One cutout 31 is provided in front end angle 32, and a pair of cutouts may be provided at the rear in the angle legs 21, 22 at 33 and 34, just forward of the rear end angle 35.

The upper bench 40 has a generally rectangular frame 41, preferably of angle, with upper bench frame side pieces 42, 43 and transversely extending front and rear end pieces 44, 45. The upper bench rectangular frame 41 rests on front and rear leg pairs 46, 47 and 48, 49. The front legs 46, 47 are affixed to the upper bench frame side pieces 42, 43, and the front end piece 44, while the rear legs 48, 49 are about 2½ to 3 inches (6.1 to 7.4 cm) in front of the rear end piece 45, being affixed to a respective upper bench frame side piece 42, 43. A respective fixed rod 50, 51 extends transversely through the bottom end portion of each pair of upper bench legs and projects to the sides. The transverse rods 50, 51 are vertically equidistant from the bottom of the upper bench rectangular frame 41.

A flat flange 52 projects horizontally from the upper bench rear end piece 45, to be used as a handle in moving the upper bench from one position to another. Socket structure 53, preferably paired vertical tubes 54, 55 welded to a crossmember 56, is fixed on the front of the upper bench front legs for engagement with pivot bracket member 81 of the leg extension-leg curl assembly 80. Rod 57 is fixed transversely through upper bench frame side pieces 42, 43, and each end of rod 57 passes respectively through one of the rear seat side angle projections 64, 65 of a respective rear seat side angle 62, 63. Rod 57 permanently connects the rear seat 60 to the upper bench frame 41. Rod 57 is also used as a handle to move the upper bench from one position to another.

Front seat 70 has front seat side angles 72, 73 with respective projecting front ends 74, 75. These projecting ends 74, 75 slide under the transversely extending front end piece 44 of the upper bench from a rearward direction in order to hold the front seat 70 in place on the upper bench frame 41.

For the nesting or collapsed interfit of the upper bench 40 with the lower bench 10, the rear pair of legs 48, 49 of the upper bench and transverse rod 51 fixed through them pass downwardly through the lower bench rectangular frame 18, perhaps through the cutout openings 33, 34 which may be in the lower bench channel side angles 19, 20, and the front pair of legs 46, 47 of the upper bench pass down beyond the front end of the lower bench. In this nested position, the upper bench rectangular frame 41 is positioned spatially within the same horizontal plane as the lower bench rectangular frame 18. The upper bench rectangular frame 41 is supported in this horizontal plane because the upper bench frame side pieces 42, 43 rest upon and are transverse to the front end angle 32 of the lower bench, and the upper bench rear end piece 45 rests upon and is contained between the lower bench channel side angles 19, 20, making contact with the lower bench channel side angles, on the legs 21, 22 at locations (38 shown) that are just behind the paired rear holddown flanges 27, 28. The paired rear holddown flanges 27, 28 also keep the upper bench from sliding forward on the lower bench by blocking the upper bench rear end piece 45. In FIG. *2a*, this nesting of the upper and lower bench frames is recognizable by the fact that front seat pad 71 and rear seat pad 61 appear to be resting directly on the lower bench rectangular frame 18, whereas in actuality the front and rear seat pads are attached to the upper bench frame 41.

The Leg Extension-Leg Curl Assembly

A centrally located leg extension-leg curl assembly 80 can be detachably affixed to the front end of the upper bench 40 by inserting paired studs 82, 83, which are part of the pivot bracket member 81, into the paired vertical tubes 54, 55 of the socket structure 53 which is fixed on the front of the front legs 46, 47 of the upper bench. The pivot bracket member 81 also has as a component part a hooked clamping flange 84 that can have either detachably positioned with it or permanently attached to it a leg extension/leg curl seat 130. FIG. 1 shows the leg extension/leg curl seat 130, with attached top horizontal pads 132, 133 and front vertical pads 134, 135, detachably positioned with the hooked clamping flange 84, such that the hooked clamping flange 84 hooks over the unpadded, mid-portion of the support angle 131 of the leg extension/leg curl seat 130. The hooked clamping flange functions not only to support the leg extension-leg curl assembly 80 on the upper bench but also to relieve torque loading on the leg extension-leg curl assembly during the inclined bench pressing exercise. The hooked clamping flange provides both support and torque loading relief for the leg extension-leg curl assembly because it is proportioned for hooking over and behind the front transverse end piece 44 of the upper bench 40. In FIG. *2a*, the right half of leg extension/leg curl seat 130 has been removed for exposition of the engagement of hooked clamping flange 84 with upper bench front transverse end piece 44 and support angle 131 of the leg extension/leg curl seat 130.

The "L"-shaped member 91 of the leg extension-leg curl assembly 80 has through it a detachable pivot pin 92 and a locking pin hole 93. The pivot pin 92 and locking pin hole 93 may be in alignment along an imaginary line that bisects the apex of the "L"-shape. The pivot pin 92 also passes through the paired, parallel-spaced steel plates 85, 86 of the pivot bracket member 81. The paired plates 85, 86 of the pivot bracket member extend at about 30 degrees upward and in a forward direction from the hooked clamping flange 84, and the "L"-shaped member 91 is pivotally affixed by pivot pin 92 between plates 85, 86. The paired steel plates 85, 86 have through them aligned locking holes 89 in addition to a pair of aligned pivot holes 90 through which is inserted the pivot pin 92. The aligned locking holes 89 accept a detachable steel locking pin 94 which, when used for a specific mode of exercise bench function, will prevent rotational movement of the "L"-shaped member 91. A transverse stopper bar 95 is welded from the bottom edge of plate 85 to the bottom edge of plate 86. The stopper bar 95 functions to limit pivoting of the "L"-shaped member toward the front legs of the upper and lower benches 40, 10.

The leg extension arm 96 and leg curl arm 97 of the "L"-shaped member each has at the end opposite the apex of the "L"-shaped member, on each side of arms 96 and 97, a respective foot pad 98, 99, 100, 101. These foot pads, which may be cylindrical, may be mounted in pairs by respective bolts 102, 103 that pass axially through the pads and through the arms 96, 97. Cable hole 104 in the leg extension arm 96 of the "L"-shaped member attaches a cable from any suitable weight stack. Pulley 17 at the front end of the lower bench 10 provides a guide for the weight stack cable.

SECOND POSITION

The Benches

FIGS. 1 and *2b* will be described together to indicate the SECOND POSITION or mode of interfit of the upper and lower benches 40, 10, an inclined intermediate position for the upper bench.

In this position, the rear legs 48, 49 of the upper bench 40 with fixed transverse rod 51 are passed downwardly through the lower bench rectangular frame 18, but the front legs 46, 47 of the upper bench are standing on the front of the lower bench frame 18. For this front end support of the upper bench, the front leg transverse rod 50 of the upper bench is supported by the lower bench channel side angles 19, 20 and held behind the lower bench front stops 25, 26.

For rear end support of the upper bench, the upper bench frame side pieces 42, 43 rest directly upon and transverse to the lower bench rear end angle 35. Upper bench rear legs 48, 49 also contact the lower bench rear end angle, acting as stops to prevent the declined upper bench 40 from sliding in a rearward direction on the lower bench frame 18 (see FIG. 2*b*).

The Leg Extension-Leg Curl Assembly

Figure 2B:
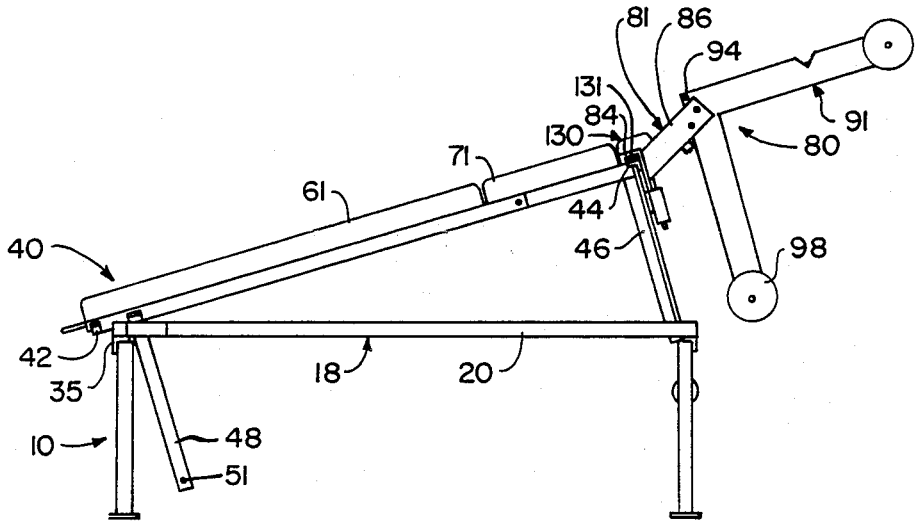
FIG. 2*b* is a similar view of a second relative interfit position.

In this SECOND POSITION of interfit between the upper and lower benches 40, 10, the leg extension-leg curl assembly 80 is held on the front end of the upper bench as previously described. To restrict rotation of the "L"-shaped member 91 to a predetermined arc, a detachable steel locking pin 94, which is proportioned to extend across the upper edges of the paired, parallel steel plates 85, 86 of the pivot bracket member 81, may be inserted into the locking pin hole 93 (see FIG. 2*a*) of the "L"-shaped member 91. As seen in FIG. 2*b*, the locking pin 94 is spatially positioned clear of but adjacent to the upper edge of each of the parallel plates 85 (not shown in FIG. 2*b*), 86. In FIG. 2*b*, the right half of leg extension/leg curl seat 130 has been removed for exposition as noted.

In FIG. 2*b*, the user of this multi-purpose exercise bench would be lying in a supine position on the front and rear seat pads 71, 61 with his (her) torso tilted on the declined upper bench 40 and his (her) head at the rear end of the upper bench. So that the user does not slide down the decline toward the rear end of the exercise bench, he would utilize the leg extension-leg curl assembly 80 as a foot-hold mechanism by taking the following steps: (1) insert, as stated above, the detachable steel locking pin 94 into the locking pin hole 93 of the "L"-shaped member 91 of the leg extension-leg curl assembly, and (2) physically apply pressure to the leg extension foot pads 98, 99 from the rearward direction with a respective leg extension foot pad being positioned across the insteps of the user's feet. At the end of a predetermined angle of rotation, the "L"-shaped member with attached leg extension foot pads 98, 99 will be blocked from further rotation because the locking pin 94 will hit down on the top edges of the paired plates 85, 86 of the pivot bracket member. Consequently, the leg extension foot pads will function as foot-holds across the insteps of the user's feet, keeping him from sliding down the inclined bench pad surface.

THIRD POSITION

The Benches

Figure 2C:
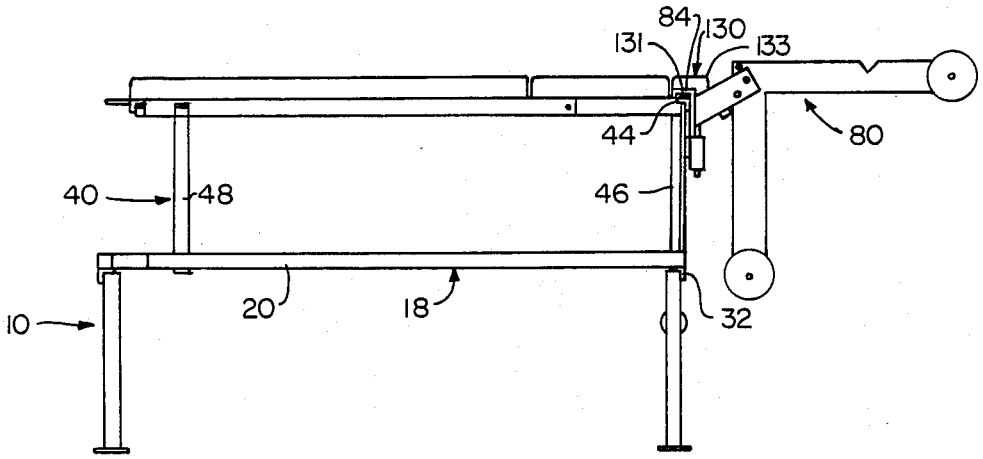
FIG. 2*c* is a similar view of a third relative interfit position.

FIGS. 1 and 2*c* will be described together to indicate the THIRD POSITION or mode of interfit of the upper and lower benches 40, 10. Here, the upper bench legs 46, 47, 48, 49 stand upright on the lower bench frame 18. Upright stability of the elevated upper bench 40 on the lower bench 10 is maintained because: (1) the fixed transverse rods 50, 51 of the respective front and rear leg pairs of the upper bench are supported by and contained between the channel side angles 19, 20 of the lower bench, (2) the rear transverse rod 51 is held beneath the paired rear holddown flanges 27, 28 at the rear of the lower bench, (3) the front transverse rod 50 fits forward of the stops 25, 26 at the front of the lower bench, and (4) the bottom ends of the front legs 46, 47 of the upper bench 40, which insert into the cutout 31 in the front end angle 32 of the lower bench, extend below the upper edge of the front end angle 32 of the lower bench, thereby blocking forward movement of the upper bench.

The Leg Extension-Leg Curl Assembly

In this THIRD POSITION of interfit between the upper and lower benches 40, 10, the leg extension-leg curl assembly 80 is held on the front of the upper bench as previously described. In FIG. 2*c*, the right half of leg extension/leg curl seat 130 has been removed for exposition as noted.

These figures show that the leg extension/leg curl seat 130 has a support angle 131 that rests directly upon the upper bench front end piece 44 when the leg extension-leg curl assembly 80 is attached to the front of the upper bench 40. The leg extension/leg curl seat 130 may have a length of 18 to 22 inches (45.7 to 55.9 cm) along its long axis. Since the width of the front end of the exercise bench is only 10½ to 12 inches (26.7 to 30.4 cm), a longer length for the leg extension/leg curl seat 130 was selected so as to provide greater thigh support and seating stability for the user when he is seated at the front end of the exercise bench performing leg extension exercises.

There are two, top horizontal pads 132, 133, and two, front vertical pads 134, 135 affixed to support angle 131 of the leg extension/leg curl seat 130. Each of the horizontal pads 132, 133 is recessed approximately one-half to three-quarter inches (1.3 to 1.9 cm) from the frontal surface of the respective vertical pads 134, 135. Because of this recessed pad-design feature, a small cavity is created behind each of the flexed knee joints of the user during the leg extension exercise. As a result, the user does not experience the pressure of the pad surface on the tendons in the back of the knee joint, thereby reducing the chance of compression type injury to these tendons.

In the THIRD POSITION, FIG. 2*c*, the user can sit at the front end of the upper bench 40, facing in a forward direction. Because the upper bench 40 is standing upright on and parallel with the lower bench 10, the user has sufficient foot clearance from the floor for doing leg extension exercises, using the leg extension-leg curl assembly 80.

FIRST POSITION WITH SEAT VARIATIONS

Figure 3:
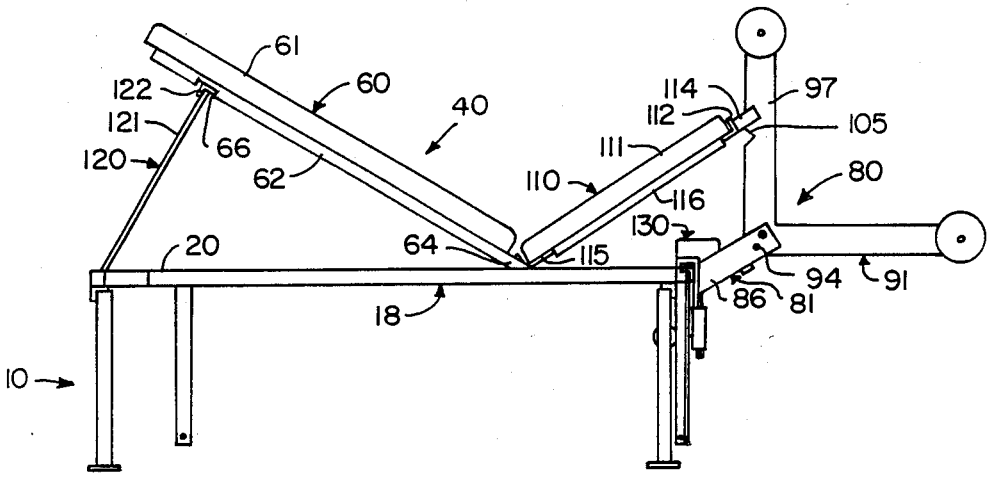
FIG. 3 is a view similar to that of FIG. 2*a*, with different seating arrangement.

FIGS. 1 and 3 will be described together to show a further mode of use for this multi-purpose exercise bench, namely inclined bench pressing. With the upper and lower benches 40, 10 in the FIRST POSITION, or nested position, the "L"-shaped member 91 of the leg extension-leg curl assembly 80 may be prevented from pivoting by the steel locking pin 94 that may be inserted through the aligned locking holes 89 of the paired steel plates 85, 86 of the pivot bracket member 81 and the locking pin hole 93 (not shown) in the "L"-shaped member 91. When these three locking holes are in alignment, so that the steel locking pin 94 will pass through all three holes simultaneously, the leg curl arm 97 of the "L"-shaped member 91 will be immobilized in an upright position. The front seat is removed and a similar, but longer and narrower width inclined bench pressing front seat 110, having inclined seat pad 111, frame angles 116, 117, front angle piece 112, and rear angle piece 115, is substituted for the standard front seat. The inclined bench pressing front seat 110 is supported in an inclined position by the leg curl arm 97, at notch 105, and by the upper bench frame side pieces 42, 43 that are nested within the lower bench frame 18. In FIG. 3, front angle piece 112 and notch 105 fit for bracing. To ensure lateral stability for the inclined bench pressing front seat 110, the two parallel projections 113, 114 of the front angle piece 112 engage and hold the leg curl arm of the "L"-shaped member, while the rear angle piece 115 of the inclined bench pressing front seat fits between the rear seat side angle projections 64, 65 of the respective rear seat side angles 62, 63.

The rear seat 60 is, as previously stated, permanently attached at its front end by rod 57 to the upper bench frame 41. The rear seat 60 can be pivoted to an inclined position by lifting the rear end of the rear seat. The pivot point for the rear seat 60 is at rod 57 which attaches the rear seat to the upper bench. The rear seat is held in the inclined position at the rear end of the exercise bench by an "I"-shaped prop 120 that may be of either fixed length, or adjustable length so as to give the user a multiple selection for the number of degrees of incline for the rear seat pad 61. In FIG. 3, the right half of the leg extension/leg curl seat 130 has been removed for exposition as noted.

The "I"-shaped prop is composed of three parts, namely a central steel post 121 (which may be adjustable), and two parallel steel end pieces 122, 125 that are perpendicular to the central steel post 121. To ensure that the "I"-shaped prop is stabilized on the exercise bench, the bottom end piece 125 is contained between the lower bench channel side angles 19, 20, and held within the paired rearmost "U"-clips 29, 30 of the lower bench, while the upper end piece 122 of the "I"-shaped prop inserts into the cutouts 66, 67 in the respective rear seat side angles 62, 63.

The rear seat 60, when in the inclined position, also acts as a stop and a holddown mechanism for the inclined bench pressing front seat 110. The rear end angle 115 of the inclined bench pressing front seat is lodged against the upper surface of the rear seat side angles 62, 63, preventing the inclined bench pressing front seat 110 from sliding toward the back of the exercise bench when the user is seated on the inclined bench pressing front seat; and the rear seat 60 is also designed so that the front end of the rear seat pad 61 overlaps the rear end of the inclined bench pressing front seat 110, holding the rear portion of seat pad 111 and rear end angle 115 of the inclined bench pressing front seat in place on the upper bench frame.

STRUCTURAL DETAILS OF THE EXERCISE BENCH

Figure 4:
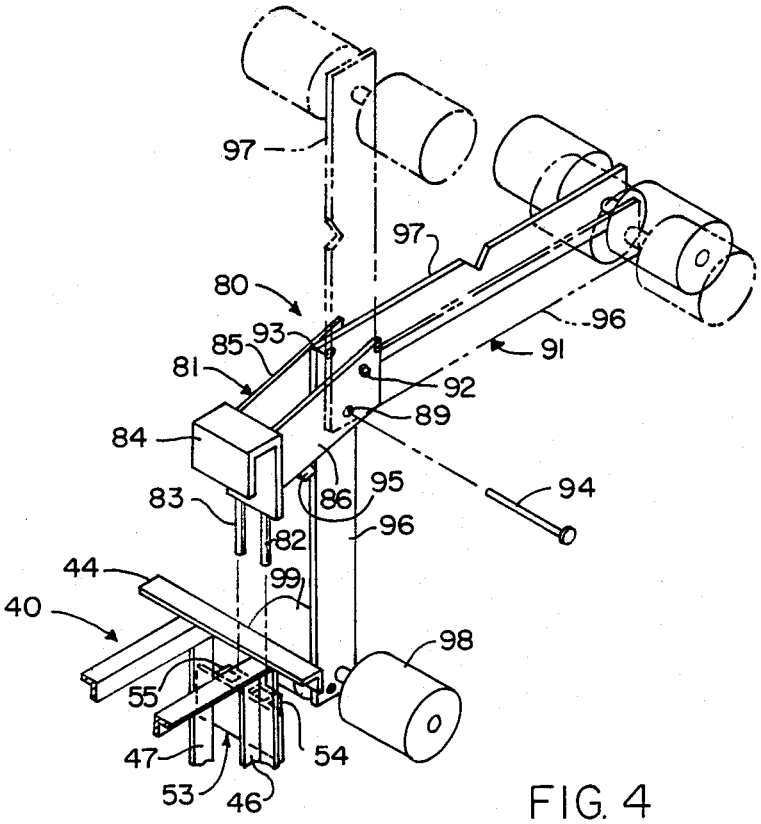
FIG. 4 is an exploded perspective view showing details of the pivot assembly generally indicated in the other views; the broken lines indicate a position of operation.

FIG. 4 details the fit of the leg extension-leg curl assembly 80 to the front end of the upper bench 40. Each of the vertical tubes 54, 55 of the socket structure 53, that is welded to the front end of the upper bench 40, detachably receives a respective stud 82, 83. The studs 82, 83 extend down from the hooked clamping flange 84 of the pivot bracket member 81. Additionally, the hooked clamping flange 84 caps over the top of the upper bench front transverse end piece 44 and between the upper bench front legs 46, 47, for support and torque loading relief of the leg extension-leg curl assembly 80, simultaneously with the studs 82, 83 engaging the respective vertical tubes 54, 55. The paired, parallel plates 85, 86 that are welded to the hooked clamping flange 84 hold the "L"-shaped member 91 by pivot pin 92 which pivotally affixes the "L"-shaped member within the channel opening that is formed by the parallel spatial positioning of the plates 85, 86.

This figure also shows the two relative starting positions for the "L"-shaped member 91 of the leg extension-leg curl assembly prior to initiating a particular exercise. The down position for the "L"-shaped member is represented by the solid line illustration. In the down position, the long axis of the leg extension arm 96 of the "L"-shaped member is in a vertical or near vertical plane, while the long axis of the leg curl arm 97 of the "L"-shaped member is in a horizontal or near horizontal plane. The leg extension arm 96 is blocked from rotating clockwise, as seen in FIG. 4, by the stopper bar 95, thereby providing a starting position that has adequate space for the user's feet between the front legs of the upper and lower benches and the foot pads 98, 99 of the leg extension arm 96. The down position for the "L"-shaped member is the starting position for leg extension-leg curl exercising.

The up position for the "L"-shaped member 91 is represented by the broken line illustration. In the up position, the long axis of the leg curl arm 97 of the "L"-shaped member is in a vertical or near vertical plane, while the long axis of the leg extension arm 96 of the "L"-shaped member is in a horizontal or near horizontal plane. The "L"-shaped member 91 can be held in the up position and prevented from pivoting by inserting steel locking pin 94 through both the aligned locking holes 89 of the paired, parallel plates 85, 86 and the locking pin hole 93 of the "L"-shaped member. Locking pin hole 93 is brought into alignment with locking holes 89 when the "L"-shaped member 91 is rotated to the up position. In the up position, leg curl arm 97 of the "L"-shaped member is used as a support post for the inclined bench pressing front seat 110 as seen in FIG. 3.

Figure 5:
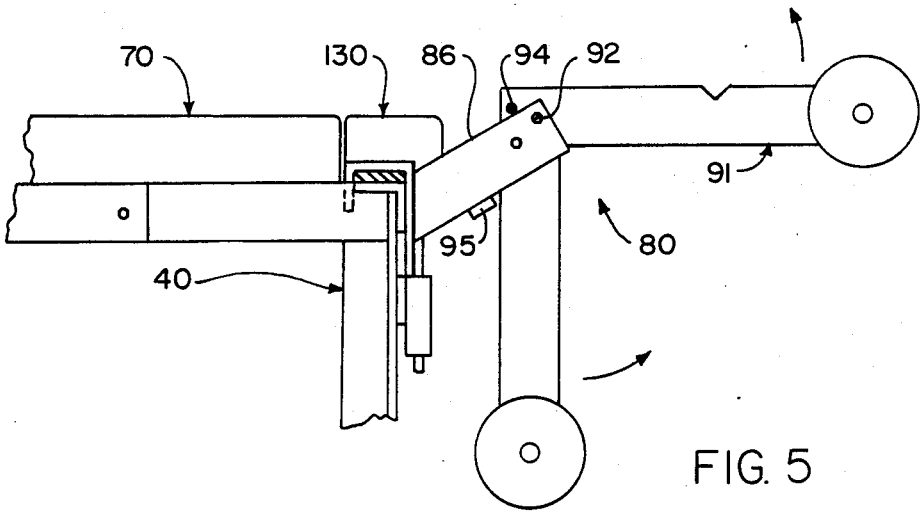
FIG. 5 is a fragmentary side elevational detail of a position of the pivot assembly; and, FIG. 6 is a rear quarter fragmentary detail of a prop for angling a seat portion.

FIG. 5 shows how the leg extension-leg curl assembly 80 in the SECOND POSITION of upper and lower bench interfit may be limited in pivotal motion about the pivot pin 92 by a steel locking pin 94 inserted into the "L"-shaped member 91. As previously noted for FIG. **2*b*, the steel locking pin 94 may be inserted into the locking pin hole 93 (see FIG. 2*b*) of the "L"-shaped member 91, thereby positioning the locking pin clear of but adjacent to the upper edges of the paired plates 85 (not shown), 86. Counterclockwise rotation of the "L"-shaped member 91, as viewed in FIG. 5, will cause the steel locking pin 94 to hit down on the top edges of the paired steel plates 85 (not shown), 86, thereby blocking any additional rotation of the "L"-shaped member 91**.

Figure 6:
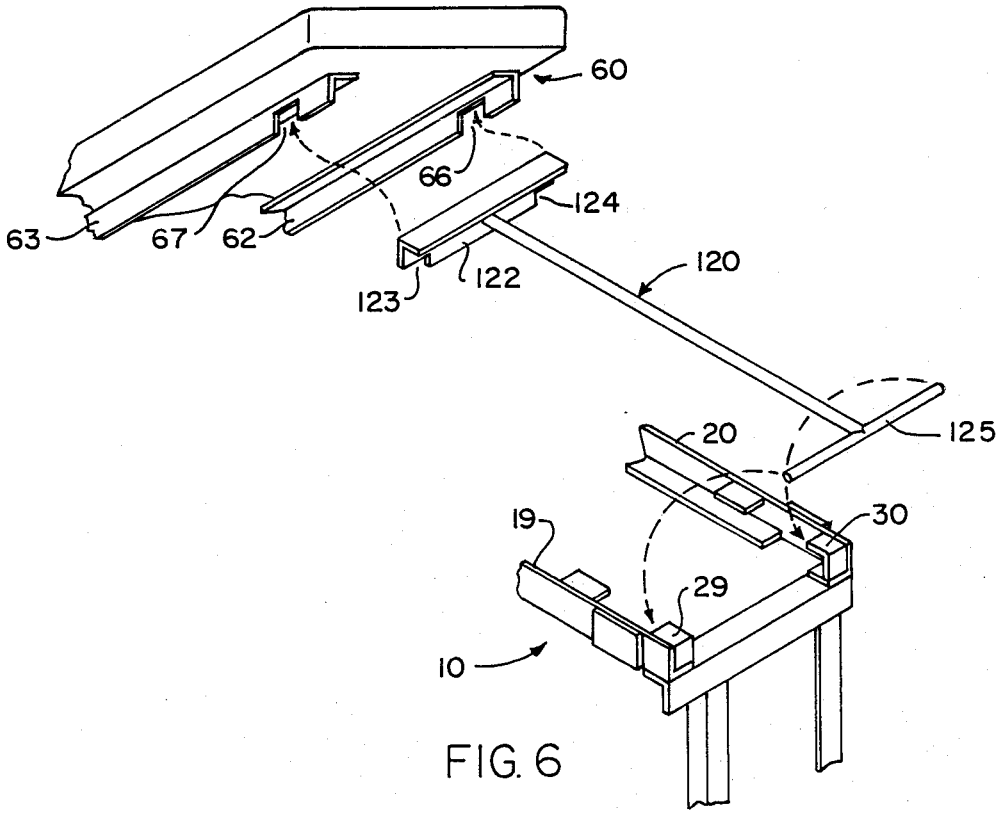

FIG. 6 shows how the "I"-shaped prop 120 engages both the underside of the rear end of the rear seat 60 and the rear end of the lower bench 10. The bottom end piece 125 of the "I"-shaped prop is contained between the lower bench frame side angles 19, 20 and held within the paired rearmost "U"-clips 29, 30 of the lower bench, while the upper end piece 122 of the "I"-shaped prop inserts into cutouts 66, 67 in the respective rear seat side angles 62, 63 and is held by the notches 123, 124 in the upper end piece 122 between the rear seat side angles 62, 63.

Structural materials for the system may be of mild steel. The rods may be one-half to three-quarter inches (12 to 24 mm) in diameter. The angles may have various dimensions, the most common being one and one-quarter by one and one-quarter by one-eighth inches (3.1 by 3.1 by 0.3 cm) for the front and rear seat side angles, one and one-quarter by one and one-quarter by one-quarter inches (3.1 by 3.1 by 0.6 cm) for the upper and lower bench frame side angles and side pieces, and one and one-half by one and one-half by three-sixteenth inches (3.8 by 3.8 by 0.5 cm) for the upper and lower bench legs.

This invention is not to be construed as limited to the particular forms disclosed within, since these are to be regarded as illustrative rather than restrictive. It is, therefore, to be understood that the invention may be practiced within the scope of the claims otherwise than as specifically described.

What is claimed and desired to be protected by United States letters patent is:

1. A system for adjustably supporting a user at a plurality of heights and angles for doing exercises such as bench presses, sit-ups, leg extensions and leg curls, comprising: a lower bench, an upper bench separate from the lower bench, the upper and lower benches having each an integral frame and a plurality of fixed legs extending downwardly therefrom, a seat structure, means for attaching the seat structure to the upper bench, means permitting nesting the upper bench, in a first position, on the lower bench, means for supporting the upper bench, in a second position, on the lower bench at an inclined angle to the lower bench, and means for standing the upper bench, in a third position, on the lower bench.

2. A system as recited in claim 1, each of said upper and lower bench frames being rectangular, and said fixed legs extending under respective adjacent front and rear corner portions of said rectangular frames of the upper and lower benches.

3. A system as recited in claim 2, means for detachably interlocking the upper bench parallel on the lower bench in said first position, means for detachably interlocking the upper bench on the lower bench in said second position, and means for detachably interlocking the upper bench on the lower bench in said third position.

4. A system as recited in claim 2, said fixed legs of the lower bench being of equal length.

5. A system as recited in claim 2, the means permitting nesting the upper bench, in a first position, on the lower bench including the lower bench rectangular frame comprising: opening-defining structure for permitting passage of the upper bench fixed legs through the lower bench rectangular frame, and the lower bench having a length providing for downward passage of the upper bench fixed legs beyond an end of the lower bench.

6. A system as recited in claim 5, the upper bench fixed legs including front leg structure and rear leg structure having respectively a front leg transverse member and a rear leg transverse member, and the means for supporting the upper bench, in a second position, on the lower bench at an inclined angle including the lower bench rectangular frame having channel sides proportioned for detachably supporting the front leg transverse member with the rear leg transverse member passed downwardly through the opening defined by said opening-defining structure and the upper bench rectangular frame resting on the lower bench rectangular frame.

7. A system as recited in claim 2, the upper bench having a front end, an "L"-shaped member, padding means on the end of each arm of the "L"-shape, a portion of the seat structure having first and second ends, means for pivotally affixing the "L"-shaped member to the front end comprising a pivot bracket member, a first pin pivoting the "L"-shaped member to the pivot bracket member, and means enabling using the "L"-shaped member as an upright post providing for resting said portion of the seat structure at an inclined angle against the "L"-shaped member with said first end on an intermediate portion of the upper bench rectangular frame and said second end propped against the "L"-shaped member.

8. A system as recited in claim 7, said means enabling using the "L"-shaped member as an upright post including means for preventing pivoting of the "L"-shaped member.

9. A system as recited in claim 7, socket structure upright on the front end of the upper bench, and said pivot bracket member including: means for engaging the socket structure and a hook proportioned for hooking the front end of the upper bench when the means for engaging is engaged with the socket structure.

10. A system as recited in claim 9, said seat structure comprising a leg extension/leg curl seat including a support angle proportioned for lying across the front end of the upper bench with ends of the support angle extending laterally beyond the upper bench and a respective pad on each end of the support angle; each pad comprising a horizontal pad member and a vertical pad member adjoining said horizontal pad member and fixed relative to the horizontal pad member, and forming a recess at said adjoining at a location for relieving pressure on tendons behind a user's knee joint during leg extension exercising.

11. A system as recited in claim 9, said seat structure comprising a leg extension/leg curl seat including a support angle proportioned for lying across the front end of the upper bench with ends of the support angle extending laterally beyond the upper bench and a respective pad on each end of the support angle; the leg extension/leg curl seat having a space between said pads proportioned for receiving the hook thereover for retention by the hook when the hook hooks the front end of the upper bench.

12. A system as recited in claim 9, the means for engaging including downwardly extending stud structure engaging the socket structure simultaneously with said hooking of the front end of the upper bench.

13. A system as recited in claim 7, and means further enabling using the "L"-shaped member as an upright post, comprising the "L"-shaped member having structure defining a notch in a rearward portion of the "L"-shaped member for bracing said portion of said seat structure.

14. A system as recited in claim 7, the seat structure including a rear seat with a front end, a detachable front seat and a detachable incline seat for use in place of the detachable front seat; said means for attaching the seat structure including a rod transversely through the upper bench rectangular frame and the rear seat, and said detachable incline seat proportioned for lodging, when inclined, against the front end of the rear seat.

15. A system as recited in claim 14, the front seat having a pair of forward projecting end portions proportioned for sliding under the front end of the upper bench and holding the front seat in place on the upper bench.

16. A system as recited in claim 14, the incline seat having a pair of forward projections for engaging the "L"-shaped member.

17. A system as recited in claim 16, and means for holding the rearmost portion of the rear seat at an upward angle relative to the upper bench rectangular frame.

18. A system as recited in claim 17, the means for holding the rearmost portion of the rear seat comprising a detachable prop extending from cutout portions in the rear seat to the lower bench rectangular frame.

19. A system as recited in claim 18, the detachable prop including an upper transverse end member having structure defining a plurality of notches engaging cutout portions in the rear seat.

20. A system as recited in claim 18, the lower bench rectangular frame including clip structure, said clip structure including a pair of clips, each with a forward facing opening, and the detachable prop engaging said pair of clips.

21. A system as recited in claim 2, the means for standing the upper bench, in a third position, on the lower bench comprising: said lower bench rectangular frame being an upper part of said lower bench, and said upper bench fixed legs comprising front leg structure and rear leg structure proportioned for supporting the upper bench parallel with the lower bench during said standing of the upper bench on the lower bench.

22. A system as recited in claim 21, each leg structure on the upper bench having fixed thereto a transverse member proportioned for detachably engaging said lower bench rectangular frame during said standing of the upper bench on the lower bench.

23. A system as recited in claim 2, the seat structure including a rear seat with a front end, a detachable front seat and a detachable incline seat for use in place of the detachable front seat; said means for attaching the seat structure including a rod transversely through the upper bench rectangular frame and the rear seat, and said detachable incline seat proportioned for lodging, when inclined, against the front end of the rear seat.

24. A system as recited in claim 23, the upper bench having a front end, and the front seat having a pair of forward projecting end portions proportioned for sliding under the front end of the upper bench and holding the front seat in place on the upper bench.

25. A system as recited in claim 23, the upper bench having a front end, a detachable upright member on the front end of the upper bench in position for serving as a support post, and the detachable incline seat having a pair of forward projections for engaging the upright member.

26. A system as recited in claim 23, and means for holding the rearmost portion of the rear seat at an upward angle relative to the upper bench rectangular frame.

27. A system as recited in claim 26, the means for holding the rearmost portion of the rear seat comprising: a detachable prop extending from cutout portions in the rear seat to the lower bench rectangular frame.

28. A system as recited in claim 26, the detachable prop including an upper transverse end member having structure defining a plurality of notches engaging cutout portions in the rear seat.

29. A system as recited in claim 27, the lower bench rectangular frame including clip structure, said clip structure including a pair of clips, each with a forward facing opening, and the detachable prop engaging said pair of clips.

30. A system as recited in claim 2, the upper bench having a front end, and said seat structure comprising a leg extension/leg curl seat including a support angle proportioned for lying across the front end of the upper bench with ends of the support angle extending laterally beyond the upper bench and a respective pad on each end of the support angle; each pad comprising a horizontal pad member and a vertical pad member adjoining said horizontal pad member and fixed relative to the horizontal pad member, and forming a recess at said adjoining at a location for relieving pressure on tendons behind a user's knee joint during leg extension exercising.

31. A system as recited in claim 2, the upper bench having a front end, a socket structure upright on the front end of the upper bench, and a pivot bracket member including: means for engaging the socket structure and a hook proportioned for hooking the front end of the upper bench when the means for engaging is engaged with the socket structure.

32. A system as recited in claim 31, said seat structure comprising a leg extension/leg curl seat including a support angle proportioned for lying across the front end of the upper bench with ends of the support angle extending laterally beyond the upper bench and a respective pad on each end of the support angle; the leg extension/leg curl seat having a space between said pads proportioned for receiving the hook thereover for retention by the hook when the hook hooks the front end of the upper bench.

* * * * *